US012539007B2

(12) United States Patent
Yoon et al.

(10) Patent No.: US 12,539,007 B2
(45) Date of Patent: Feb. 3, 2026

(54) CHARGING CRADLE INCLUDING COVER OPENING/CLOSING DEVICE AND CLEANING STATION FOR SAME

(71) Applicant: SAMSUNG ELECTRONICS CO., LTD., Suwon-si (KR)

(72) Inventors: Yeohwan Yoon, Suwon-si (KR); Kyungwon Moon, Suwon-si (KR); Chulgon Kim, Suwon-si (KR); Jinhoon Kim, Suwon-si (KR); Jaehoon Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 351 days.

(21) Appl. No.: 18/307,230

(22) Filed: Apr. 26, 2023

(65) Prior Publication Data

US 2024/0090726 A1 Mar. 21, 2024

Related U.S. Application Data

(63) Continuation of application No. PCT/KR2023/001598, filed on Feb. 3, 2023.

(30) Foreign Application Priority Data

Feb. 10, 2022 (KR) ..... 10-2022-0017627
Mar. 17, 2022 (KR) ..... 10-2022-0033207

(51) Int. Cl.
*A47L 9/28* (2006.01)

(52) U.S. Cl.
CPC ..... *A47L 9/2873* (2013.01); *A47L 2201/022* (2013.01); *A47L 2201/024* (2013.01)

(58) Field of Classification Search
CPC ..... A47L 9/2873; A47L 9/009; A47L 9/0054; A47L 9/10
See application file for complete search history.

(56) References Cited

U.S. PATENT DOCUMENTS

2020/0315419 A1 10/2020 Sato et al.
2021/0052121 A1* 2/2021 Kim ..... A47L 9/0063
2022/0095862 A1 3/2022 Kim et al.

FOREIGN PATENT DOCUMENTS

CN 113116215 7/2021
CN 113116222 7/2021
(Continued)

OTHER PUBLICATIONS

Search Report and Written Opinion dated May 11, 2023 issued in International Patent Application No. PCT/KR2023/001598.

*Primary Examiner* — C. A. Rivera
(74) *Attorney, Agent, or Firm* — Nixon & Vanderhye P.C.

(57) ABSTRACT

According to an embodiment of the disclosure, a charging cradle for mounting and charging a wireless vacuum cleaner, may include: a cradle, and a cleaning station including an automatic cover opening/closing device physically connected to the wireless cleaner and disposed on the cradle. The automatic cover opening/closing device may include: a lower case, an upper case integrally connected to the lower case, a middle case coupled to each of the lower case and the upper case and configured to be movable away from the lower case or toward the lower case, the middle case being rotatably coupled to the lower case, a cover configured to open/close the upper case, a driver comprising a motor and meshing with the middle case and configured to provide a force for rotating and moving the middle case, and a mechanical device provided in the middle case and configured to open/close the cover in response to operation of the driver.

20 Claims, 16 Drawing Sheets

(56) References Cited

FOREIGN PATENT DOCUMENTS

| | | | |
|---|---|---|---|
| CN | 113662483 | | 11/2021 |
| KR | 101256103 | B1 | 4/2013 |
| KR | 102166771 | B1 | 10/2020 |
| KR | 20210019940 | A | 2/2021 |
| KR | 10-2021-0128783 | | 10/2021 |
| KR | 10-2021-0128786 | | 10/2021 |
| KR | 10-2315420 | | 10/2021 |
| KR | 20210128786 | A | 10/2021 |
| KR | 10-2021-0157905 | | 12/2021 |

* cited by examiner

CHARGING CRADLE INCLUDING COVER OPENING/CLOSING DEVICE AND CLEANING STATION FOR SAME

CROSS-REFERENCE TO RELATED APPLICATIONS

This application is a continuation of International Application No. PCT/KR2023/001598 designating the United States, filed on Feb. 3, 2023, in the Korean Intellectual Property Office and claiming priority to Korean Patent Application No. 10-2022-0017627, filed on Feb. 10, 2022, in the Korean Intellectual Property Office, and to Korean Patent Application No. 10-2022-0033207, filed on Mar. 17, 2022 in the Korean Intellectual Property Office, the disclosures of all of which are incorporated by reference herein in their entireties.

BACKGROUND

Field

The disclosure relates to an automatic cover opening/closing device provided in a charging cradle on which a wireless cleaner is cradled for charging.

Description of Related Art

Ordinary cleaners may be classified into a wired cleaner that is used in a state in which a power line is connected and a wireless cleaner that is used after being charged. Due to the convenience of use, the number of users who use wireless cleaners is gradually increasing.

In addition, wireless cleaners include a portable wireless cleaner used for vacuum cleaning the inside of a vehicle, a standing charging-type wireless cleaner that is mounted and charged in an upright state, or a wireless floor cleaner (e.g., a robot cleaner) capable of cleaning a floor while moving.

Among the above-listed wireless cleaners, the upright charging-type wireless cleaner may have a structure in which a suction unit is disposed on one end, a handle is disposed on the other end, and a dust bin is disposed between the suction unit and the handle. In addition, the wireless floor cleaning cleaner may have a structure in which a suction unit and a dust container are disposed in a housing to store sucked dust.

The dust bin of the wireless vacuum cleaner of this type has a structure in which the cover is opened when the inner space is filled with dust, the dust bin is emptied, and then the cover is closed. For example, opening/closing of the cover for emptying the dust bin may be performed manually or may be performed in a semi-automatic manner in which the cover is automatically closed after the cover is manually opened and then the dust bin is emptied.

However, when opening/closing of the cover of the dust bin is automatically implemented for convenience, there is a problem in that it is necessary to add a structure for automatically opening the cover. Since such an automatic cover opening device has a complicated structure, there are problems of increasing of the number of components and increasing the mounting space.

In particular, in the case of a rotary rim-type wireless cleaner, it is necessary to reduce the size of a dust bin cover in order to avoid mechanical interference between a protrusion of the rotary rim and the dust bin cover, which may result in degradation of efficiency in emptying the dust bin.

SUMMARY

Embodiments of the disclosure provide a device that automatically opens/closes a dust bin cover of a wireless cleaner by automatically opening the cover of the dust bin after the wireless cleaner is mounted on a cleaning station and automatically closing the cover when the emptying of the dust bin is completed, thereby improving user convenience, and a wireless cleaner including the device.

According to an example embodiment of the disclosure, a charging cradle for mounting and charging a wireless vacuum cleaner, may include: a cradle, and a cleaning station including an automatic cover opening/closing device physically connected to the wireless cleaner and disposed on the cradle. The automatic cover opening/closing device may include: a lower case, an upper case integrally connected to the lower case, a middle case coupled to each of the lower case and the upper case and configured to be movable away from the lower case or toward the lower case, the middle case being rotatably coupled to the lower case, a cover configured to open/close the upper case, a driver comprising a motor meshing with the middle case and configured to provide a force for rotating and moving the middle case, and a mechanical device provided in the middle case and configured to open/close the cover in response to operation of the driver.

According to an example embodiment of the disclosure, a cleaning station for a charging cradle, on which a wireless cleaner is configured to be mounted for charging, may include: a lower case, an upper case integrally connected to the lower case, a middle case coupled to each of the lower case and the upper case and configured to be movable away from the lower case or toward the lower case, the middle case being rotatably coupled to the lower case, a cover configured to open/close the upper case, a driver comprising a motor meshing with the middle case and configured to provide a force for rotating and moving the middle case, and a mechanical device provided in the middle case and configured to open/close the cover in response to operation of the driver.

According to various example embodiments of the disclosure, since the cover of the dust bin is automatically openable and closable using the mechanical device, it is possible to conveniently use the wireless cleaner.

According to various example embodiments of the disclosure, by implementing automatic opening/closing of the cover by adding a simple mechanical structure, it is possible to reduce the number of components and reduce the component mounting volume.

BRIEF DESCRIPTION OF THE DRAWINGS

In connection with the description of the drawings, the same or similar components may be denoted by the same or similar reference numerals.

DETAILED DESCRIPTION

Hereinafter, various example embodiments of the disclosure will be described with reference to the accompanying drawings. However, it shall be understood that it is not intended to limit the disclosure to specific embodiments, and that the disclosure includes various modifications, equivalents, and/or alternatives of various embodiments of the disclosure.

Figure 1A:
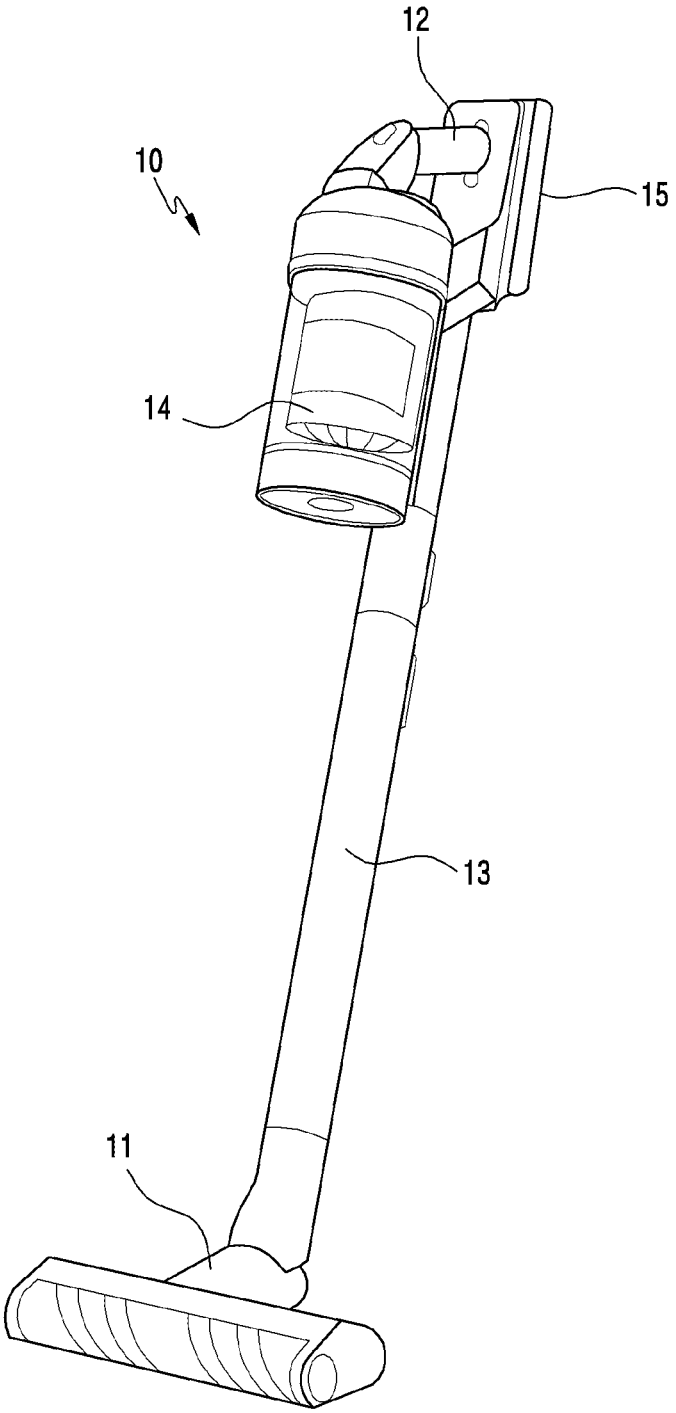
FIG. 1A is a perspective view illustrating a wireless cleaner according to various embodiments.
Figure 1B:
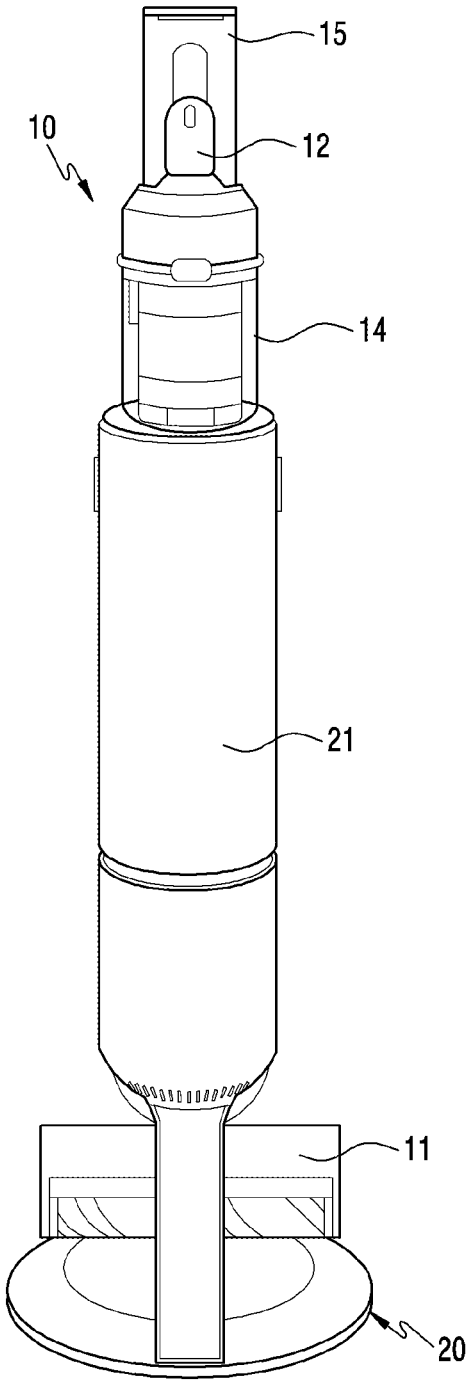
FIG. 1B is a diagram illustrating a front view in a state in which the wireless cleaner is coupled to a cleaning station using a cradle according to various embodiments.

FIG. 1A is a perspective view illustrating a wireless cleaner according to various embodiments. FIG. 1B is a front view illustrating a state in which the wireless cleaner is coupled to a cleaning station using a cradle according to various embodiments.

Referring to FIG. 1, a wireless cleaner system according to an embodiment may include a wireless cleaner 10 and a charging cradle 20. According to an embodiment, the charging cradle 20 may include a cleaning station 21. According to an embodiment, the cleaning station 21 may be placed in a substantially upright state by the charging cradle 20. According to an embodiment, the wireless cleaner 10 may include a suction unit 11, a suction pipe 13, a dust bin 14, and a handle 12. According to an embodiment, the suction unit 11, the suction pipe 13, the dust bin 14, and the handle 12 are integrally connected, and a user may perform cleaning by holding the handle 12.

According to an embodiment, when the wireless cleaner 10 is cradled on the charging cradle 20, the cleaning station 21 and the dust bin 14 may be integrally coupled. According to an embodiment, when the wireless cleaner 10 is cradled on the cleaning station 21, emptying of the dust bin of the wireless cleaner 10 and the cradling and charging of the wireless cleaner 10 may be possible. According to an embodiment, a dust screen (not illustrated), which may be a consumable, may be disposed in the inner space of the cleaning station 21.

According to an embodiment, when a start/stop button of the cleaning station 21 is pressed, the dust or the like in the dust bin 14 may escape toward the dust screen of the cleaning station.

According to an embodiment, in the wireless cleaner 10, a detachable rechargeable battery 15 may be disposed near the handle 12.

According to an embodiment, when the start button is pushed after the wireless cleaner 10 is coupled to the cleaning station 21, a cover is opened by the operation of an automatic cover opening/closing device disposed inside the cleaning station 21, and the dust or the like in the dust bin 14 is allowed to go down toward the dust screen via the automatic cover opening/closing device.

Figure 2:
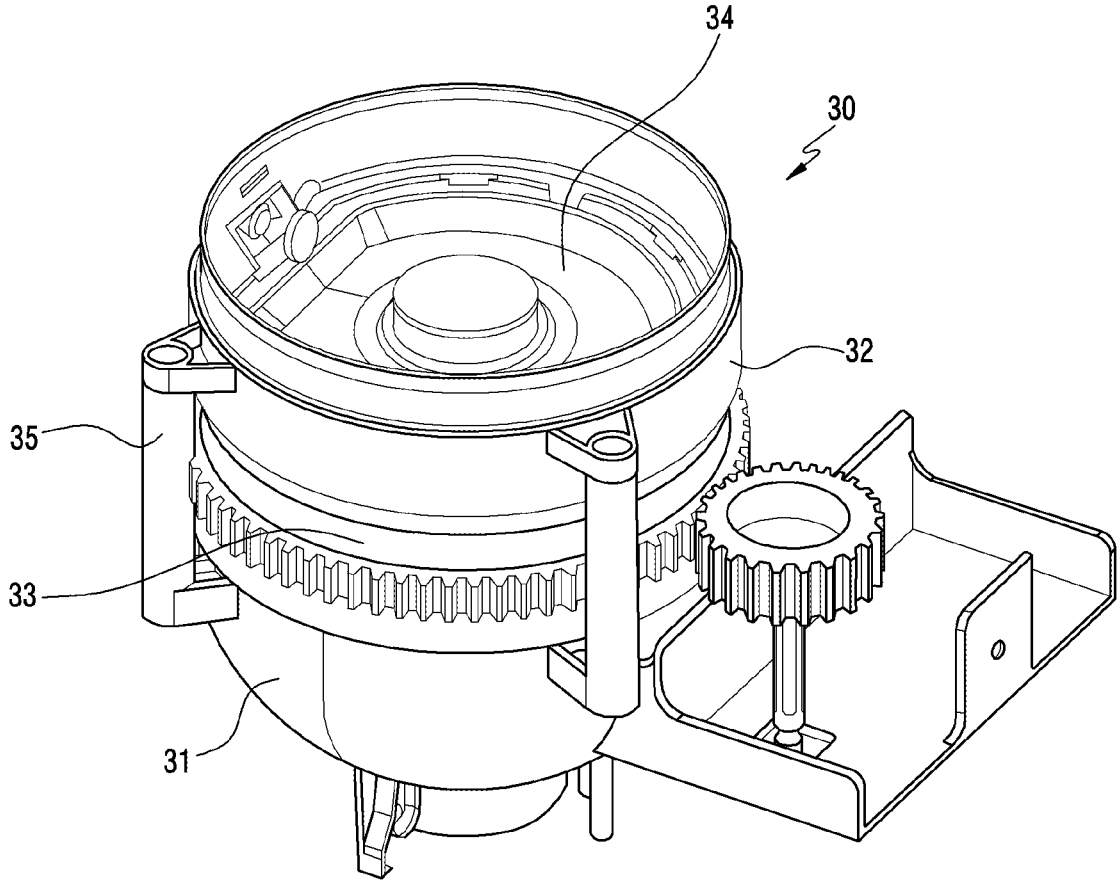
FIG. 2 is a perspective view illustrating an automatic cover opening/closing device in an assembled state according to various embodiments.
Figure 3:
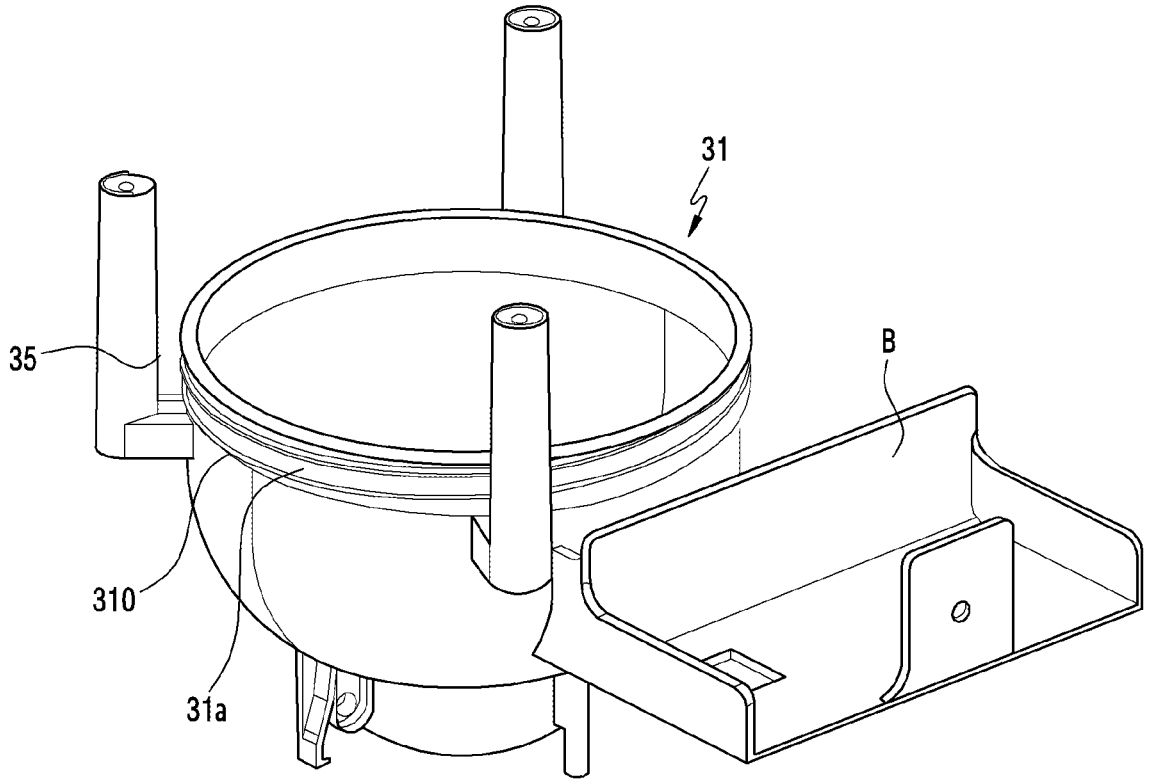
FIG. 3 is a perspective view illustrating a lower case according to various embodiments

FIG. 2 is a perspective view illustrating an automatic cover opening/closing device in an assembled state according to various embodiments. FIG. 3 is a perspective view illustrating a lower case according to various embodiments. FIG.

4 is a cross-sectional view illustrating a screw-type coupling structure between the lower case and a middle case according to various embodiments.

Figure 4:
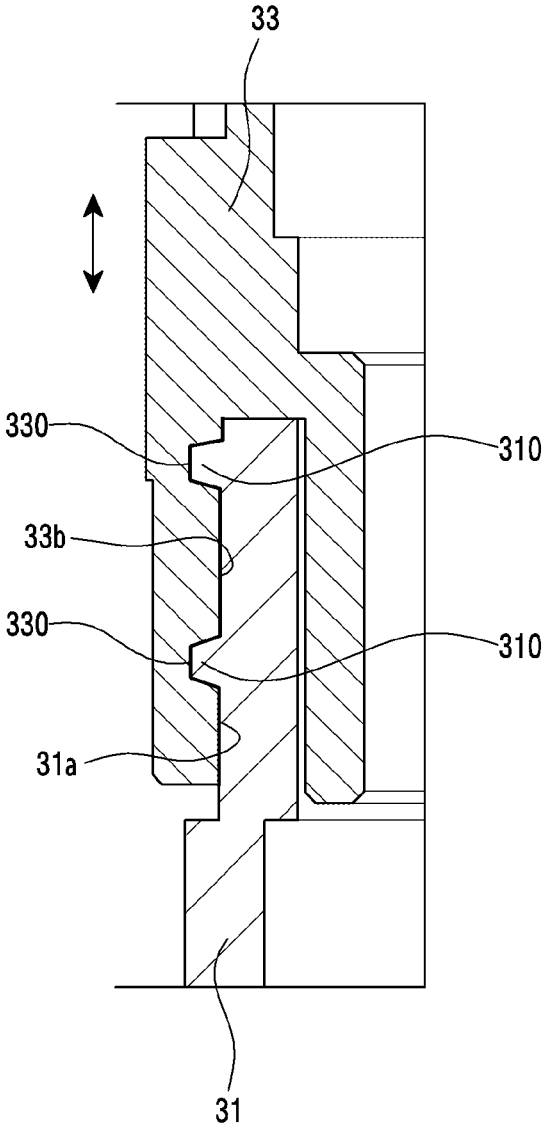
FIG. 4 is a cross-sectional view illustrating a screw-type coupling structure between the lower case and a middle case according to various embodiments.

Referring to FIGS. 2, 3 and 4 (which may be referred to as FIGS. 2 to 4), the automatic cover opening/closing device 30 included in the cleaning station 21 according to an embodiment may include a lower case 31, an upper case 32, a middle case 33, and a cover 34.

According to an embodiment, the automatic cover opening/closing device 30 may be integrally assembled by coupling the lower case 31, the middle case 33, and the upper case 32. According to an embodiment, the cover 34 may be hingedly coupled to the upper case 32 to open/close the upper case 32.

According to an embodiment, the lower case 31 may include a bin for collecting dust and may be located in the lower portion of the automatic cover opening/closing device 30.

According to an embodiment, the upper case 32 may include an inlet portion into which dust transferred through the wireless cleaner (e.g., the wireless cleaner 10 illustrated in FIG. 1A) is introduced, and on which a cover that opens/closes the upper end of the upper case 32 may be disposed. For example, the cover 34 may be coupled to the open upper end of the upper case 32 in a hinge type. According to an embodiment, the cover 34 is maintained in the closed state by a separate engagement structure, and when the locking state of the engagement structure is released, the upper case 32 may be opened while rotating downward by gravity. According to the opened state of the cover 34, the transferred dust may accumulate on the lower case 31.

According to an embodiment, the lower case 31 may be integrally connected by at least one connecting rod 35. According to an embodiment, when a plurality of connecting rods 35 are disposed, the respective connecting rod 35 may be arranged at regular intervals.

According to an embodiment, the middle case 33 may be disposed between the lower case 31 and the upper case 32 to be coupled to each of the lower case 31 and the upper case 32. According to an embodiment, one end of the middle case 33 may be coupled to the lower case 31, and the other end of the middle case 33 may be coupled to the upper case 32. According to an embodiment, the middle case 33 may be rotated on the lower case 31 by the driving of a driver and may be coupled to be movable toward the upper case 32. According to an embodiment, the middle case 33 may rotate and move by receiving power from the driver. According to an embodiment, the other end of the middle case 33 may be rotatably connected to the upper case 32.

According to an embodiment, when rotated by the driving of the driver, the middle case 33 may be movable toward the upper case 32 by a predetermined (e.g., specified) distance. According to an embodiment, the lower case 31 and the middle case 33 may be connected to each other by a screw thread coupling structure among coupling structures. For example, when the middle case 33 rotates, the middle case 33 moves upward from the lower case 31 toward the upper case 32 or, conversely, moves downward away from the upper case 32. A driving motor 40 may serve as the power source of the upward movement or down movement of the middle case 33.

According to an embodiment, the screw thread coupling structure may include a screw thread 310 provided in the lower case 31 and a screw groove 330 provided in the middle case 33. According to an embodiment, the screw thread 310 may be seated in the screw groove 330. According to an embodiment, when the middle case 33 is rotated by the driving of the driving motor 40 (refer, e.g., to FIGS. 5 and 6), the screw thread 310 may slide along the screw groove 330, thereby making middle case 33 movable toward the upper case 32.

According to an embodiment, the screw thread 310 may protrude from the outer surface 31*a* of the lower case 31, and the screw groove 330 may be recessed in the inner surface of the middle case 33.

Figure 5:
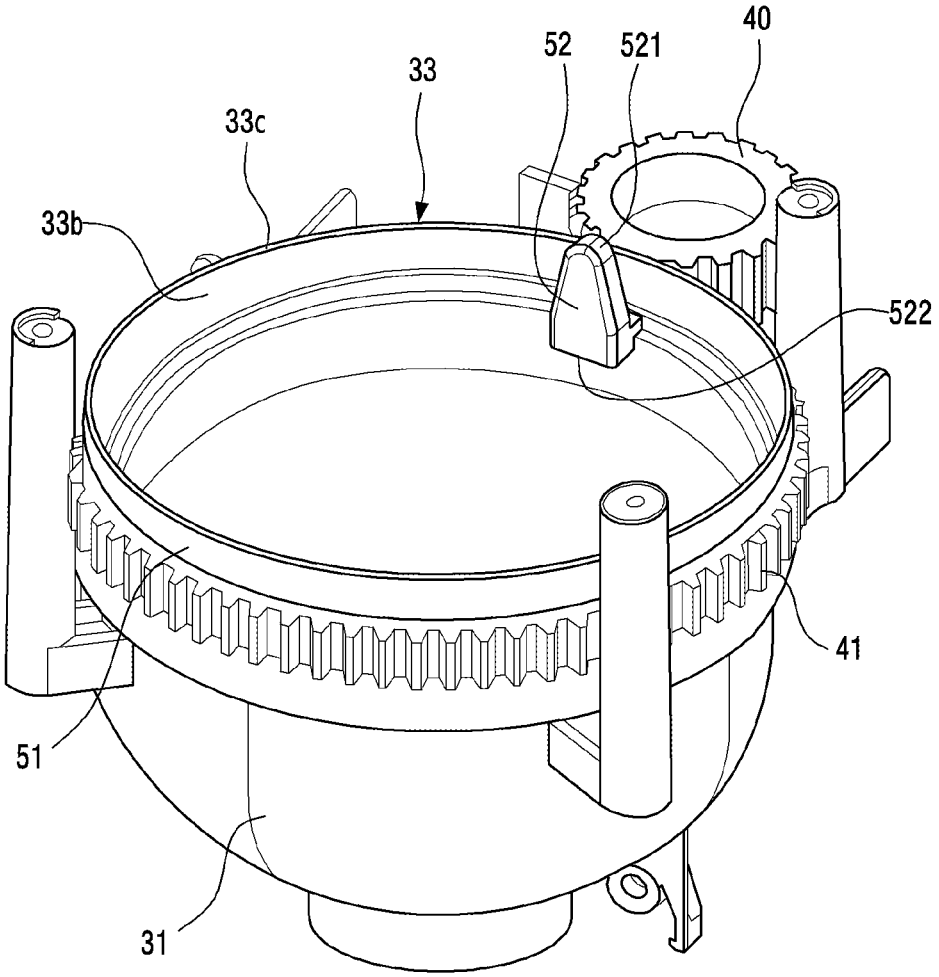
FIG. 5 is a perspective view illustrating an automatic cover opening/closing device according to various embodiments.
Figure 6:
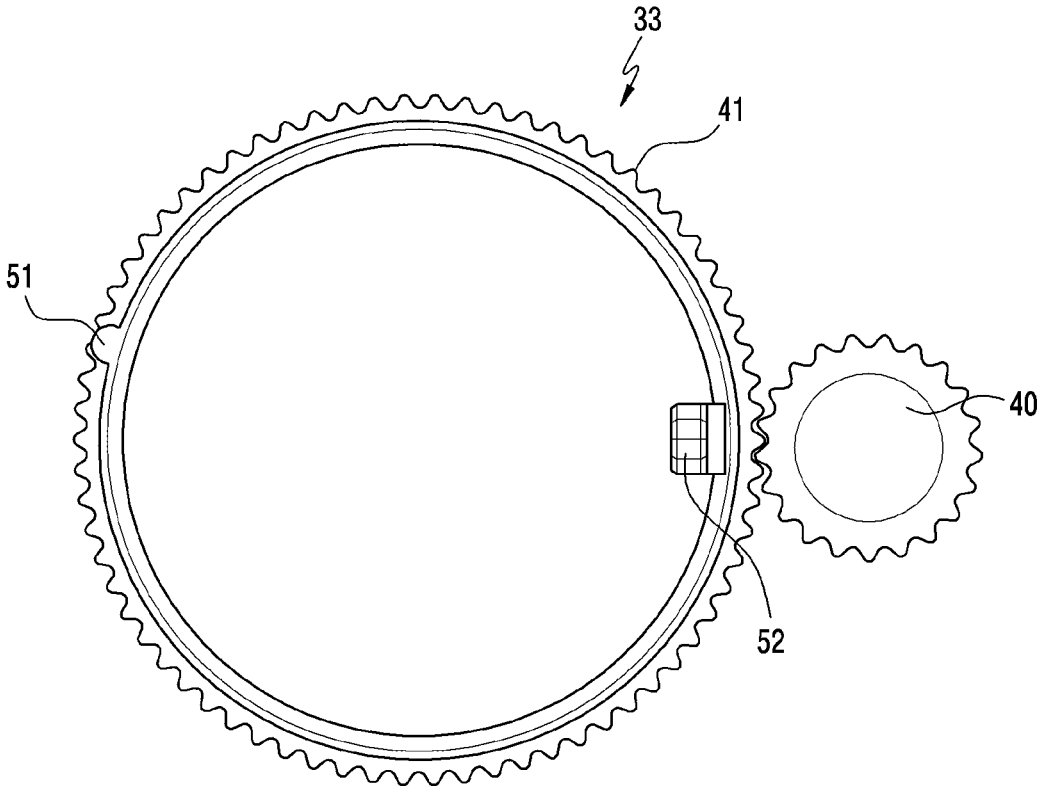
FIG. 6 is a diagram illustrating an automatic cover opening/closing device according to various embodiments.

FIG. 5 is a perspective view illustrating an automatic cover opening/closing device according to various embodiments. FIG. 6 is a diagram illustrating the automatic cover opening/closing device according to various embodiments.

Referring to FIGS. 5 and 6, according to an embodiment, the driver is a driving source for providing a force for rotating and moving the middle case 33 and may include a gear tooth structure 41 disposed on the middle case 33 and a drive motor 40 meshing with the gear tooth structure 41. For example, the gear tooth structure 41 may have a ring shape. According to an embodiment, the gear tooth structure 41 may be configured integrally with the middle case 33.

According to an embodiment, when the drive motor 40 is driven in the forward direction, the middle case 33 may move toward the upper case 32, and when the drive motor 40 is driven in the reverse direction, the middle case 33 may move away from the upper case 32.

According to an embodiment, the cleaning station 21 may include a cover opening/closing device 30 (refer, e.g., to FIG. 2) configured to automatically open/close the cover 34. According to an embodiment, the cover 34 may be disposed on the upper end of the cleaning station (e.g., the cleaning station 21 illustrated in FIG. 1B) to open/close the upper case 32. According to an embodiment, when the cover 34 is closed, the upper case 32 may be in the state of being spatially closed, and when the cover 34 is opened, the dust bin 14 may be in the state of being spatially connected to the upper case 32.

According to an embodiment, the automatic cover opening/closing device 30 may include a driver, and an opening structure and a closing structure that are mechanical injection-molded structures. According to an embodiment, the automatic cover opening/closing device 30 may be configured to cause the opening structure to open the cover 34 or cause the closing structure to close the cover 34 in response to the driving of the driver.

According to an embodiment, the opening structure may include an opening protrusion 51. Hereinafter, the opening structure will be referred to as the opening protrusion 51.

According to an embodiment, the opening protrusion 51 is provided on the outer surface 33*a* of the middle case 33 at one end of the middle case 33. According to an embodiment, the opening protrusion 51 may protrude to an outer peripheral direction and extend along the longitudinal direction of the middle case 33. According to an embodiment, the opening protrusion 51 may be provided between the upper end of the middle case 33 and the gear tooth structure 41. According to an embodiment, the extended length of the opening protrusion 51 may be about equal to the width between the upper end of the middle case 33 and the gear tooth structure 41. According to an embodiment, the opening protrusion 51 may have a semi-cylindrical shape such that at least a portion of the outer surface thereof may be curved to allow the opening protrusion 51 to smoothly slide relative to the engagement structure 53 (refer, e.g., to FIG. 7). According to an embodiment, the opening protrusion 51 may be interlocked with the engagement structure 53 depending on the rotating of the middle case 33 and may then push the opening button 340 (refer, e.g., to FIG. 7) of the cover 34 to release the closed state of the cover 34.

According to an embodiment, the closing structure may include a closing protrusion 52. Hereinafter, the closing structure will be referred to as the closing protrusion 52.

According to an embodiment, the closing protrusion 52 is provided on the inner surface 33*b* of the middle case 33 at one end of the middle case 33. According to an embodiment, the closing protrusion 52 may protrude toward the center of the middle case 33 and may extend along the longitudinal direction of the middle case 33. According to an embodiment, the closing protrusion 52 may have a curved surface on at least the outer surface thereof to allow the closing protrusion 52 to smoothly slide relative to the cover 34. According to an embodiment, the closing protrusion 52 may be interlocked with the cover 34 according to the rotational motion of the middle case 33 and then push the cover 34 into the closed state. Subsequently, the cover 34 may be engaged with the engagement structure 53 in response to the operation of the closing protrusion 52.

According to an embodiment, the closing protrusion 52 may include one end 521 facing the upper case 32 and the other end 522 facing the lower case 31. According to an embodiment, the one end 521 of the closing protrusion 52 may have a curved shape to smoothly slide relative to the cover 34.

According to an embodiment, the opening protrusion 51 and the closing protrusion 52 may be provided at positions where the protrusions face each other in the vicinity of the upper end 33*c* of the middle case 33.

Figure 7:
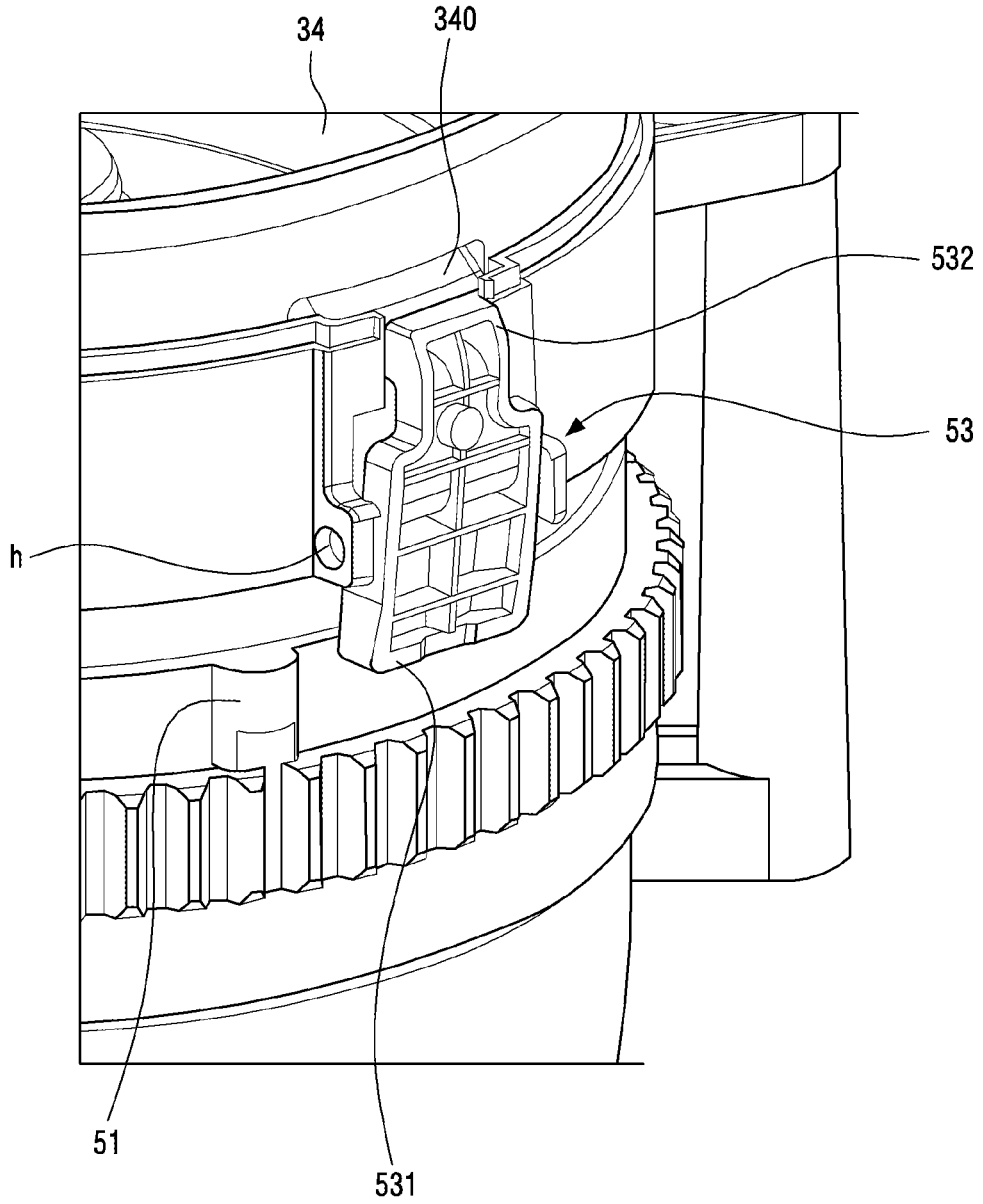
FIG. 7 is a perspective view illustrating a dust bin engagement structure according to various embodiments.

FIG. 7 is a perspective view illustrating the engagement structure of the automatic cover opening/closing device according to various embodiments.

Referring to FIG. 7, according to an embodiment, the opening protrusion 51 comes into contact with the engagement structure 53 (e.g., one end of the hook), and may then press the end of the hook in response to the rotation of the middle case 33. According to an embodiment, the engagement structure 53 may be disposed on the outer surface of the upper case 32 to be rotatable by a hinge h. According to an embodiment, the engagement structure 53 may include one end 531 configured to come into contact with the opening protrusion 51 and the other end engagement structure configured to come into contact with the opening button 340 of the cover 34. According to an embodiment, when the opening protrusion 51 presses the one end 531, the engagement structure 53 may rotate about the hinge h, and then the other end 532 may press the opening button 340. According to an embodiment, the closed state of the cover 34 may be released in response to the pressing of the opening button 340.

Referring to FIGS. 8A, 8B, 9A, 9B, 10A, 10B, 11A and 11B, the automatic opening/closing operation of the cover 34 according to various embodiments will be sequentially described.

Figure 8A:
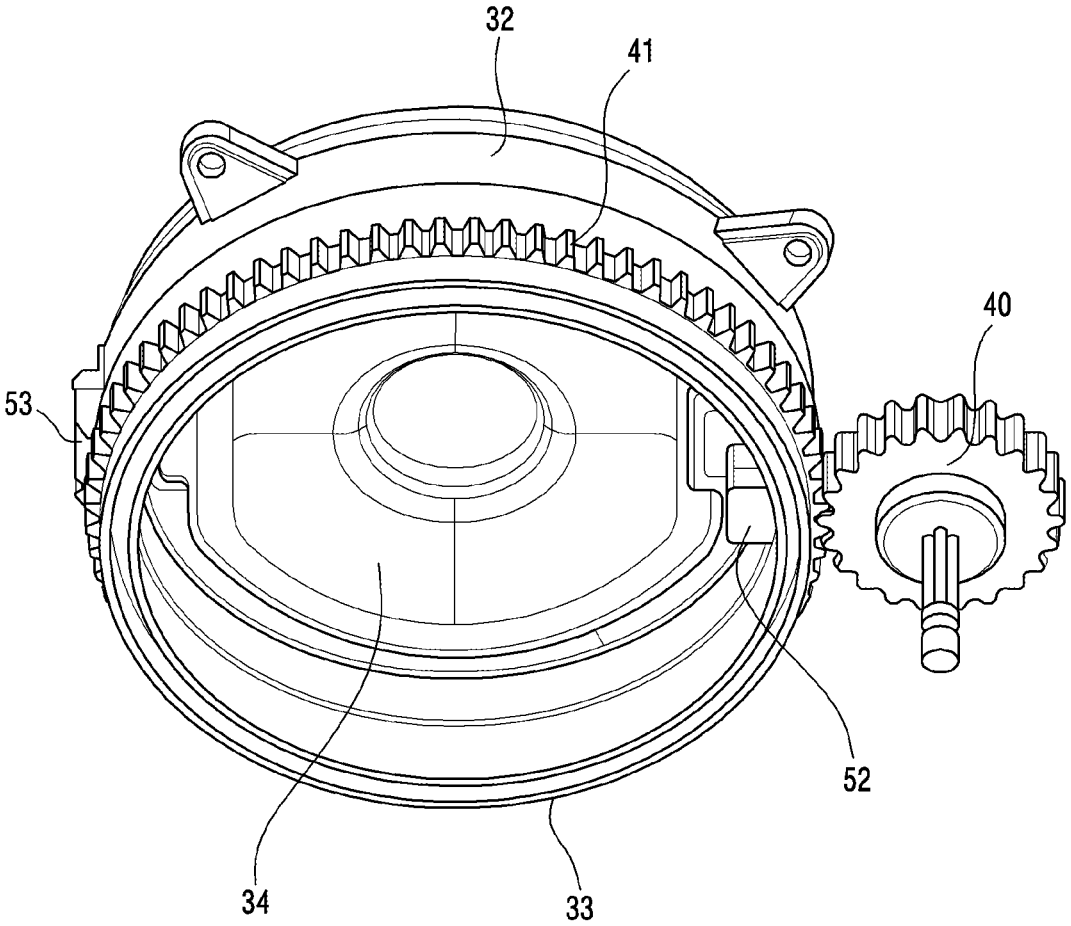
FIG. 8A is a perspective view illustrating a state before the automatic cover opening/closing device operates according to various embodiments.
Figure 8B:
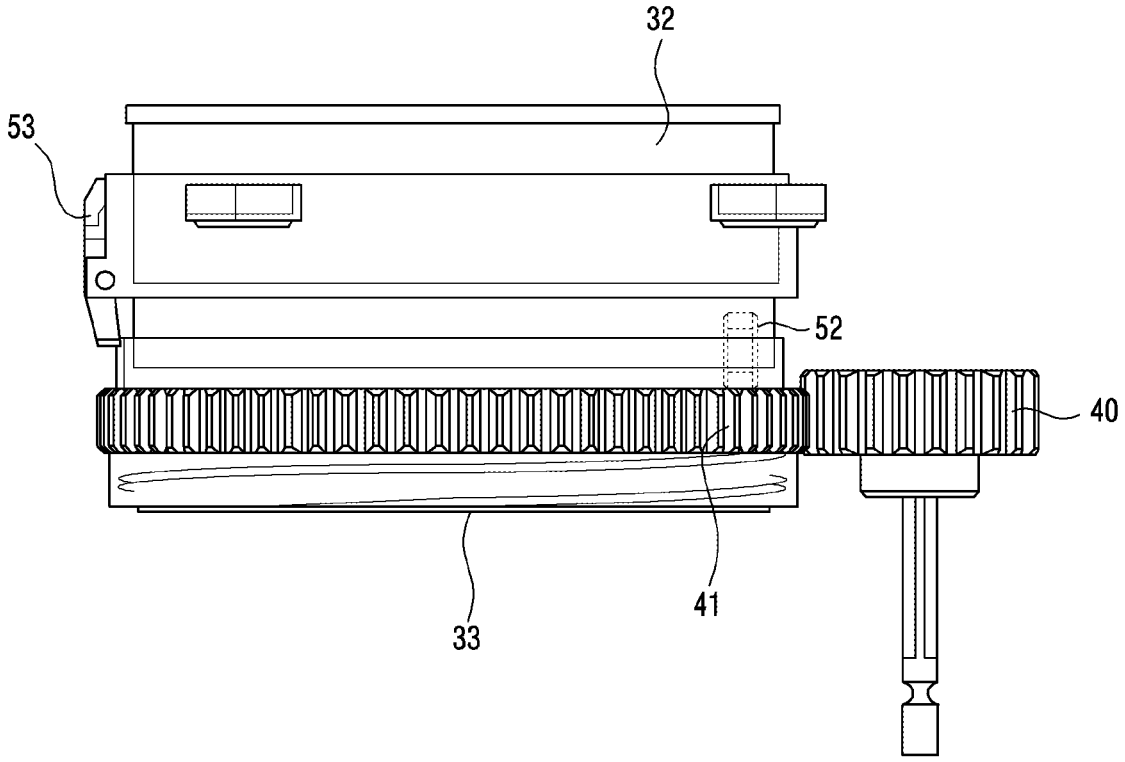
FIG. 8B is a front view of the automatic cover opening/closing device as illustrated in FIG. 8A according to various embodiments.

FIG. 8A is a perspective view illustrating a state before the automatic cover opening/closing device of the disclosure operates, and FIG. 8B is a front view of FIG. 8A according to various embodiments.

The middle case 33 illustrated in FIGS. 8A and 8B is in an initial state before the operation of the drive motor 40, the drive motor 40 may mesh with the gear tooth structure 41, and the cover 34 may be in the state of closing the upper case 32.

Figure 9A:
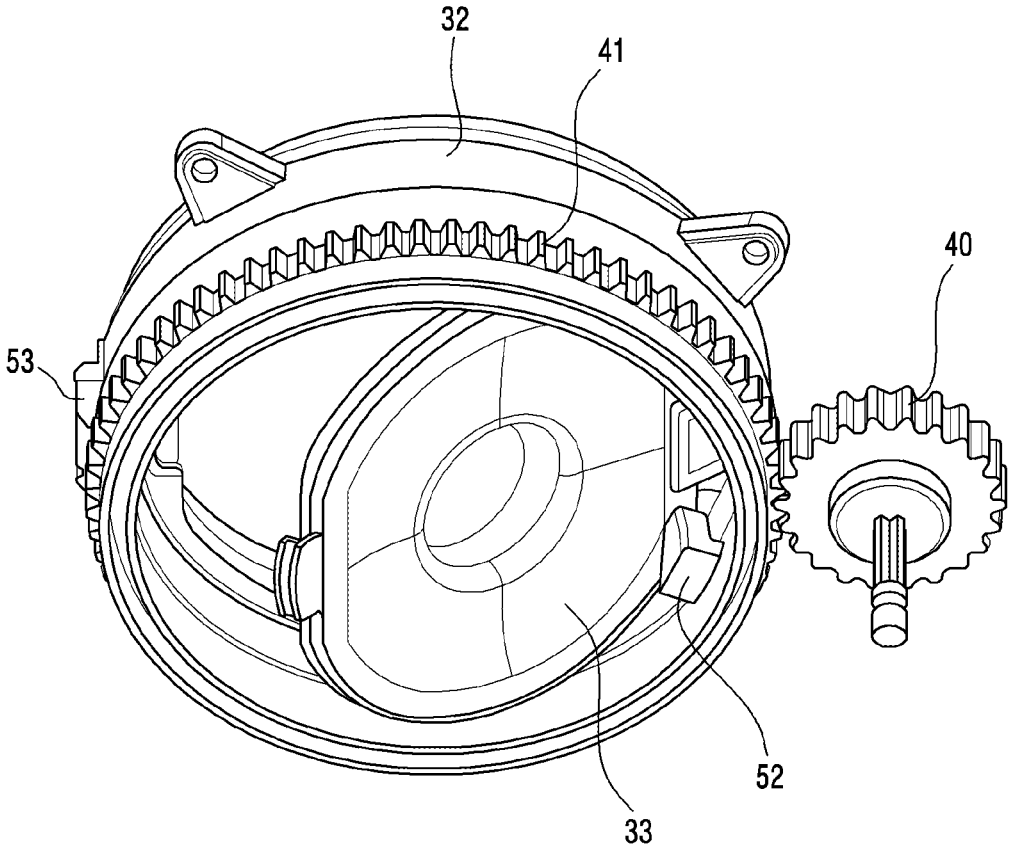
FIG. 9A is a perspective view illustrating a state in which the cover is opened by the operation of the opening protrusion according to various embodiments.
Figure 9B:
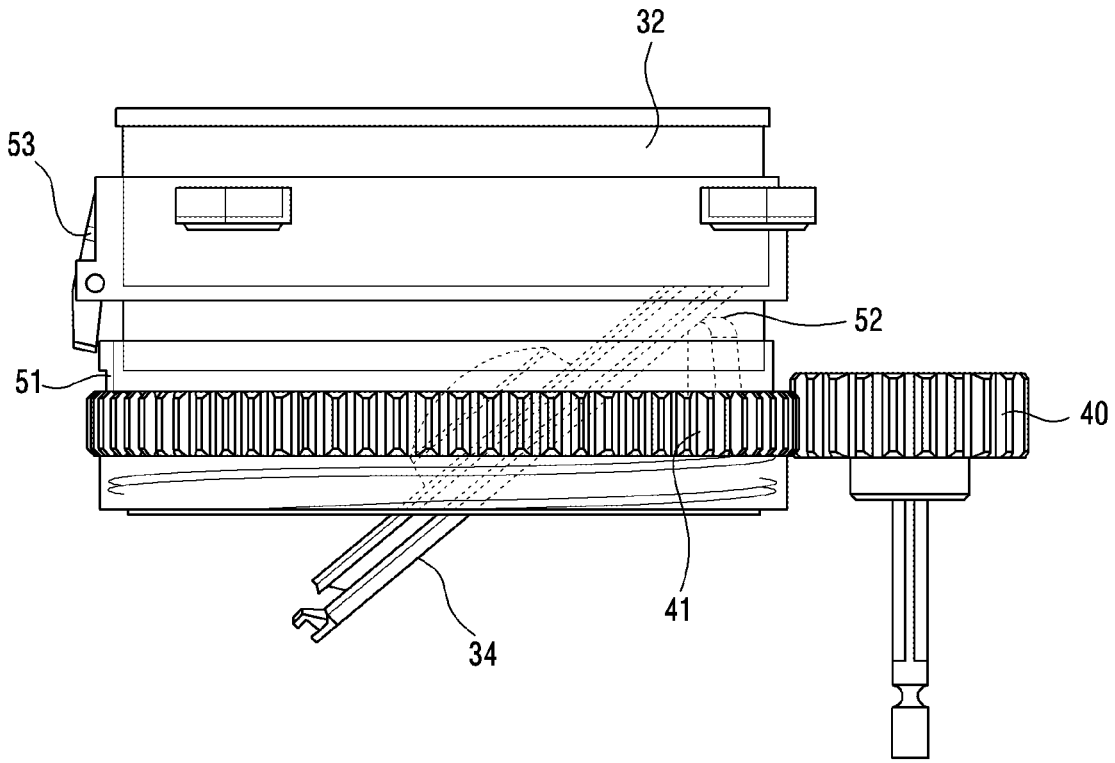
FIG. 9B is a front view of the perspective view illustrated in FIG. 9A according to various embodiments.

FIG. 9A is a perspective view illustrating a state in which the cover is opened by the operation of the opening protrusion, and FIG. 9B is a front view of FIG. 9A according to various embodiments.

Referring to FIGS. 9A and 9B, according to an embodiment, the opening protrusion 51 may be moved by the driving of the driving motor 40 to press an end of the engagement structure 53 and as a result, in response to the pressing of the opening button 340, the cover 34 may be rotated downward by gravity to be in the opened state. According to an embodiment, in the opened state of the cover 34, the closing protrusion 52 may be in contact with a portion of the cover 34.

Figure 10A:
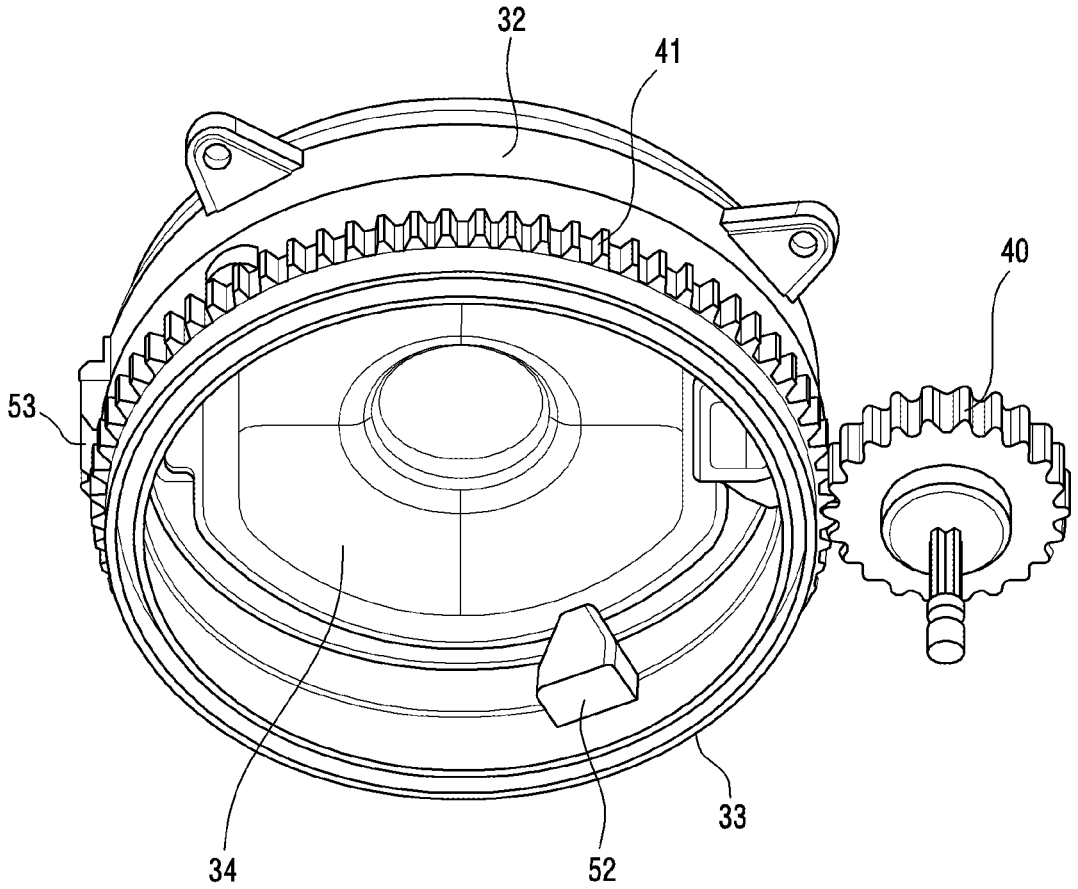
FIG. 10A is a perspective view illustrating a state in which the cover is closed by the operation of the closing protrusion according to various embodiments.
Figure 10B:
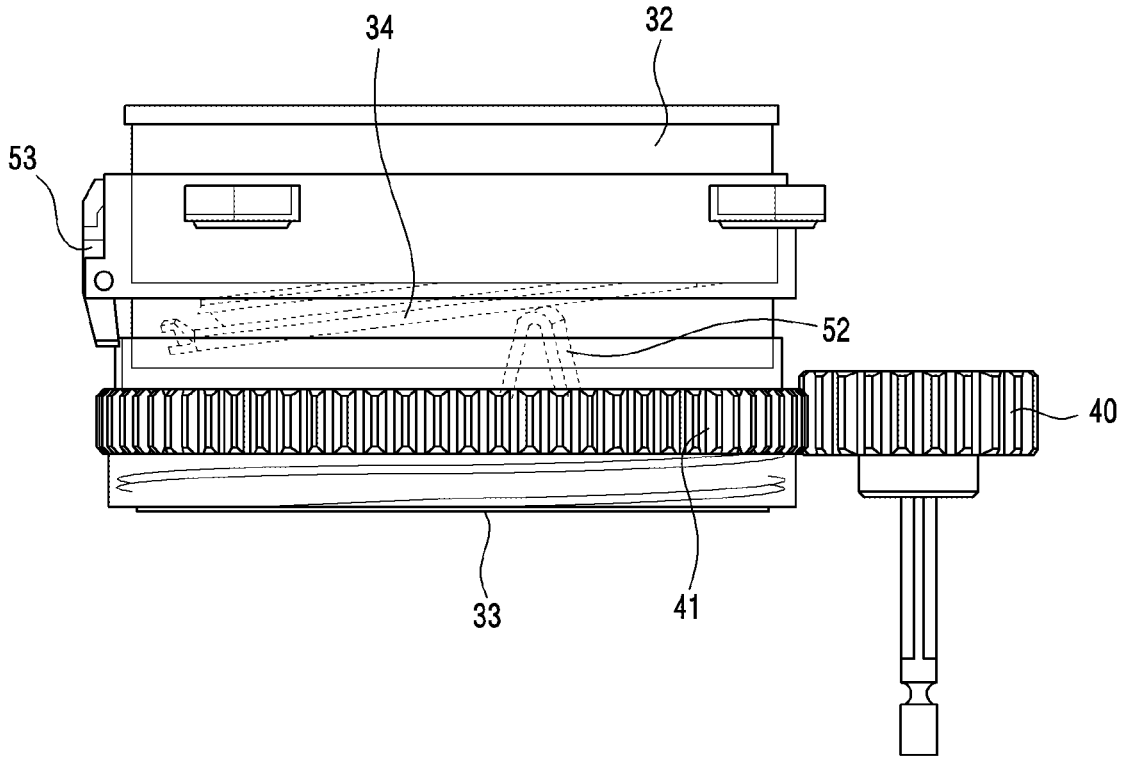
FIG. 10B is a front view of the perspective view illustrated in FIG. 10A according to various embodiments.

FIG. 10A is a perspective view illustrating a state in which the cover is closed by the operation of the closing protrusion, and FIG. 10B is a front view of FIG. 10A according to various embodiments.

Referring to FIGS. 10A and 10B, when the middle case 33 is operated by the driving of the driver, the closing protrusion 52 may slide relative to the edge portion of the cover 34, and then the cover 34 may be gradually shifted to the closed state.

Figure 11A:
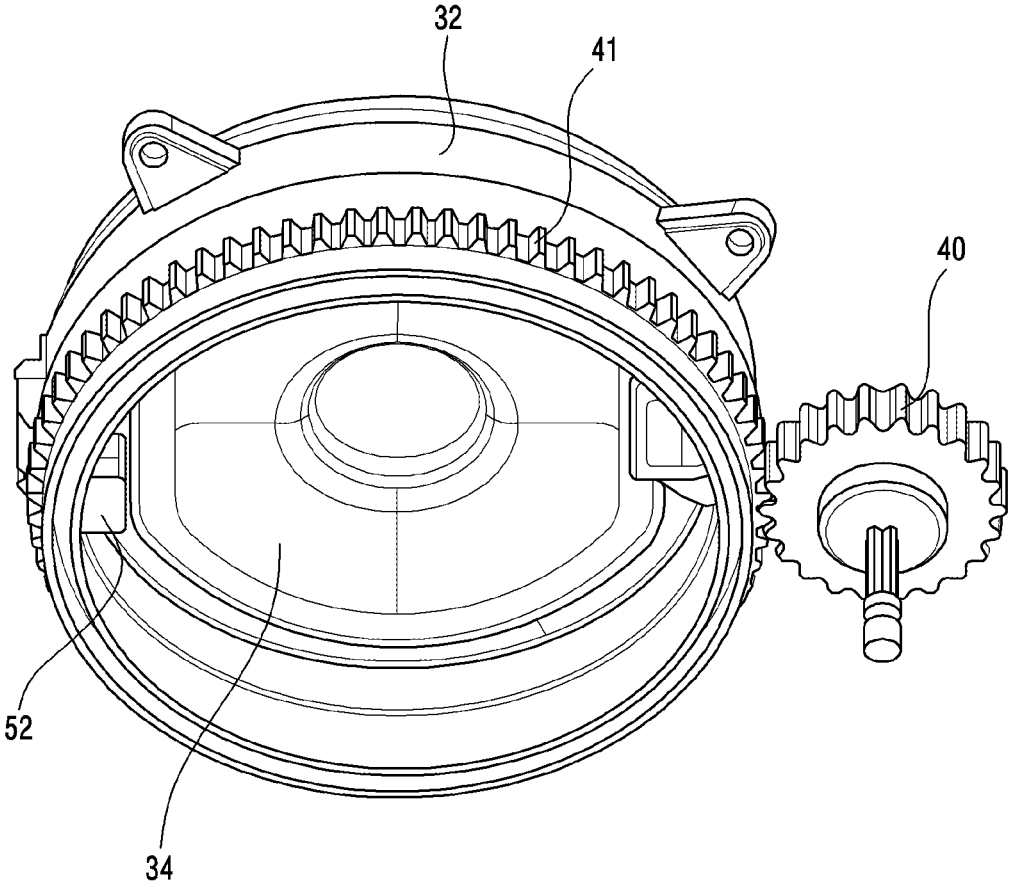
FIG. 11A is a perspective view illustrating a state in which the cover is closed by the operation of the closing protrusion according to various embodiments.
Figure 11B:
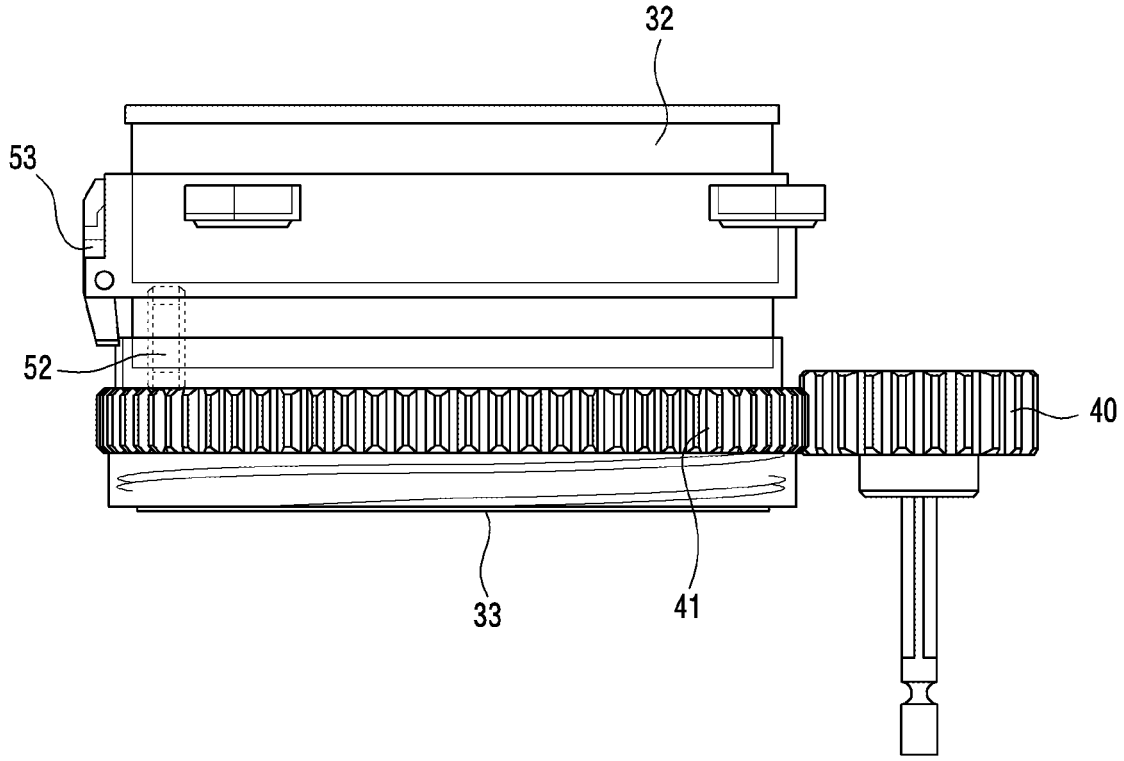
FIG. 11B is a front view of the perspective view illustrated in FIG. 11A according to various embodiments.

FIG. 11A is a perspective view illustrating a state in which the cover is closed state by the operation of the closing protrusion, and FIG. 11B is a front view of FIG. 11A according to various embodiments.

Referring to FIGS. 11A and 11B, when the middle case 33 is operated by the driving of the driver, the closing protrusion 52 may slide relative to the edge portion of the cover 34, and then the cover 34 may be engaged with the engagement structure 53, which makes it possible to maintain the closed state of the cover 34.

What is claimed is:

1. A charging cradle configured to mount and charge a wireless vacuum cleaner, the charging cradle comprising:
- a cradle; and
- a cleaning station including an automatic cover opening/closing device physically connected to the wireless cleaner and disposed on the cradle,
- wherein the automatic cover opening/closing device comprises:
  - a lower case;
  - an upper case integrally connected to the lower case;
  - a middle case coupled to each of the lower case and the upper case and configured to be movable away from the lower case or toward the lower case, the middle case being rotatably coupled to the lower case;
  - a cover coupled to the upper case and configured to open/close the upper case;
  - a driver comprising a motor and meshing with the middle case and configured to provide a force for rotating and moving the middle case; and
  - a mechanical device including at least one protrusion provided in the middle case and configured to release/connect the cover with the protrusion and by the force of the driver to open/close the upper case.

2. The charging cradle of claim 1, further comprising a screw-type coupling structure between the lower case and the middle case.

3. The charging cradle of claim 2, wherein the screw-type coupling structure comprises:
- at least one screw thread provided on an outer surface of the lower case; and
- at least one screw groove provided on an inner surface of the middle case configured to be coupled to the screw thread.

4. The charging cradle of claim 1, wherein the driver comprises:
- a drive motor; and
- a gear tooth structure provided along an outer surface of the middle case and configured to mesh with the drive motor.

5. The charging cradle of claim 4, wherein the gear tooth structure is disposed on the middle case in a ring shape.

6. A charging cradle configured to mount and charge a wireless vacuum cleaner, the charging cradle comprising:
- a cradle; and
- a cleaning station including an automatic cover opening/closing device physically connected to the wireless cleaner and disposed on the cradle,
- wherein the automatic cover opening/closing device comprises:
  - a lower case;
  - an upper case integrally connected to the lower case;
  - a middle case coupled to each of the lower case and the upper case and configured to be movable away from the lower case or toward the lower case, the middle case being rotatably coupled to the lower case;
  - a cover configured to open/close the upper case;
  - a driver comprising a motor and meshing with the middle case and configured to provide a force for rotating and moving the middle case; and
  - at least one protrusion provided in the middle case and configured to open/close the cover by the force of the driver, wherein the at least one protrusion comprises an opening protrusion provided on an outer surface of the middle case.

7. The charging cradle of claim 6, wherein the opening protrusion protrudes toward an outer periphery of the charging cradle.

8. The charging cradle of claim 6, wherein the opening protrusion extends along a longitudinal direction of the middle case by a length between an upper end of the middle case and the driver.

9. The charging cradle of claim 8, wherein the opening protrusion has a semi-cylindrical shape.

10. The charging cradle of claim 6, wherein the opening protrusion is configured to press an opening button of the cover in a closed state in response to the operation of the driver to release an engagement state of the cover.

11. The charging cradle of claim 6, wherein the at least one protrusion comprises, on an inner surface of the middle case, a closing protrusion configured to close the cover.

12. The charging cradle of claim 11, wherein the closing protrusion protrudes inwardly, extends in a longitudinal direction of the middle case, and is provided near an upper end of the middle case.

13. The charging cradle of claim 11, wherein the closing protrusion extends along a longitudinal direction of the middle case.

14. The charging cradle of claim 11, wherein the closing protrusion comprises:

one end facing the upper case; and another end facing the lower case, and wherein the one end has a curved shape configured to slide relative to the cover.

15. The charging cradle of claim 11, wherein the opening protrusion and the closing protrusion face each other.

16. A cleaning station for a charging cradle, on which a wireless cleaner is configured to be mounted for charging, the cleaning station comprising:

a lower case;

an upper case integrally connected to the lower case;

a middle case coupled to each of the lower case and the upper case, the middle case being rotatably coupled to the lower case via a screw thread such that rotation of the middle case relative to the lower case displaces the middle case away from the lower case or toward the lower case depending on a direction of rotation;

a cover configured to open/close the upper case;

a driver comprising a motor and meshing with the middle case and configured to provide a force for rotating and moving the middle case; and at least one protrusion provided in the middle case and configured to open/close the cover by the force of the driver.

17. The cleaning station of claim 16, wherein the at least one protrusion comprises:

an opening protrusion provided on an outer surface of the middle case; and a closing protrusion provided on an inner surface of the middle case.

18. The cleaning station of claim 17, wherein the opening protrusion extends along a longitudinal direction of the middle case, has a length within a width of the middle case, and has a semi-cylindrical shape.

19. The cleaning station of claim 17, wherein the closing protrusion extends along a longitudinal direction of the middle case and has a length within a width of the middle case.

20. The cleaning station of claim 19, wherein the closing protrusion comprises:

one end facing the upper case; and another end facing the lower case, and wherein the one end has a curved shape configured to slide relative to the cover.

* * * * *